US006352440B1

(12) United States Patent
Okabe et al.

(10) Patent No.: US 6,352,440 B1
(45) Date of Patent: Mar. 5, 2002

(54) LEVER-ACTUATED CONNECTOR AND METHOD FOR FORMING A CONNECTOR BODY

(75) Inventors: Toshiaki Okabe; Tetsuya Yamashita, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/632,973

(22) Filed: Aug. 4, 2000

(30) Foreign Application Priority Data

Aug. 5, 1999 (JP) ..... 11-222729

(51) Int. Cl.[7] ..... H01R 13/62
(52) U.S. Cl. ..... 439/157
(58) Field of Search ..... 439/157, 152, 439/153, 372, 352, 357, 159, 160

(56) References Cited

U.S. PATENT DOCUMENTS 6,019,620 A1 * 2/2001 Kodama et al. ..... 439/157

FOREIGN PATENT DOCUMENTS

JP 11-26070 1/1999

* cited by examiner

*Primary Examiner*—P. Austin Bradley
*Assistant Examiner*—Alexander Gilman
(74) *Attorney, Agent, or Firm*—Finnegan, Henderson, Farabow, Garret & Dunner LLP

(57) ABSTRACT

In a lever-actuated connector, on one end part of a side surface of a connector body (23) is formed a protruding lever insertion rib (27), into which an end (24C) of a lever (24) is inserted, which allows the end (24C) of the lever (24) to rock, and which extends upwardly and downwardly. An upper rib linking part (27A) that joins opposing walls that surround a lever insertion slit (31) is formed larger than a lower rib linking part (27B), and an upper through hole (32) communicates between the upper end surface of the upper rib linking part (27A) and the lever insertion slit (31). By adopting this configuration, when the lever insertion slit (31) is formed, die removal is done upwardly and downwardly, and it is not necessary to use a sliding die, thereby simplifying the die construction for the connector body (23), reducing the cost, and also enabling smooth insertion and fitting together of connectors.

6 Claims, 9 Drawing Sheets

LEVER-ACTUATED CONNECTOR AND METHOD FOR FORMING A CONNECTOR BODY

BACKGROUND OF THE INVENTION

1. Field of the Invention

The present invention relates to a lever-actuated connector, more particularly to a lever-actuated connector enabling easy forming of a connector body having a slit into which an end of a lever is inserted, and to a method for forming a connector body.

2. Related Art

A lever-actuated connector of the past is illustrated in FIG. 7 and FIG. 8, and is disclosed in the Japanese Patent Application Laid-Open Publication No. 11-26070. As shown in FIG. 7, this lever-actuated connector is generally constituted by a hood 3 integrally formed with an upper cover 2 of an electrical connection housing 1, a male connector 5 having a connector body 4 that inserts into and fits with the hood 3, and a lever 6 provided on the outside of the connector body 4 of the male connector 5, and which causes the connector body 4 to be inserted into and fitted with the hood 3.

End parts of bus bars (not shown) are housed within the upper cover 2 of the electrical connection housing 1, with male contacts of the end parts protruding within the hood 3. Rib guide grooves 7 are formed so as to protrude on both sides on one end of the hood 3. A pair of cutouts 9 are formed on an outer wall 8 that defines the rib guide grooves 7. Between the rib guide grooves 7 are inserted ribs 10 of the connector body 4, and end parts 12 of lever walls 11 of the lever 6 are inserted into and engaged with the cutouts 9, respectively. The ribs 10 formed on the connector body 4 each have a vertically elongated hole 10A for guiding insertion of the end part 12 of a corresponding one of the lever walls 11.

Guide grooves 13 are formed on the other end of the hood 3, so as to protrude at both sides thereof. The grooves 13 are configured so that guide ribs 14 protruding from the connector body 4 can be inserted. A lever lock part 15 is provided further to the end part than the guide grooves 13. This lever lock part 15 is provided with a pair of guide walls 16 protruding toward the inside of the hood 3, with a locking piece insertion space 17 defined between the guide walls 16. Inside the hood 3, the connector body 4 of the male connector 5 is inserted into and fitted by operation of the lever 6, so that female contacts (not shown) housed within the connector body 4 are thereby connected to the male contacts protruding within the hood 3.

The male connector 5 has a plurality of contact housing chambers within the connector body 4, these contact housing chambers individually housing the female contacts. A mating male contact is inserted from one end of a corresponding contact housing chamber, and an electric wire W terminated at its end on an associated female contact is lead away from the other end of the contact housing chamber.

The connector body 4 has a pair of bosses 18 protruding from central regions of both side surfaces thereof. The bosses 18 are each inserted into a pivot hole 11A that is formed at the center of a corresponding one of the lever walls 11 of the lever 6. FIG. 8 is a perspective view showing the condition in which the lever 6 is pivotally supported by the connector body 4.

In the molding of the connector body 4 of the male connector 5, the elongated holes 10A to be formed in the ribs 10 are molded by using dies to be removed in a direction, which is different from the direction of removal of other dies used for molding an associated part of the lever-actuated connector. FIG. 9 is a partial cross-sectional view showing removal directions of dies used for molding the ribs 10 of the connector body 4. As shown in the figure, the conventional lever-actuated connector needs a laterally slidable die 19A to form each elongated hole 10A, while other parts of the connector body 4 are molded by vertically removable dies 19X1 and 19X2. Thus, sliding dies are necessary for the elongated holes 10A to be formed at both sides, and an entire die configuration is complicated, with increased costs in die production and molding operation.

Further, the connector body 4 to be inserted and fitted into the hood 3 readily tilts within the hood 3, causing an interference with the hood 3, as the lever 6 is operated, resulting in a failure for the connector body 4 to be smoothly inserted and fitted.

SUMMARY OF THE INVENTION

The present invention is made with such points in view. It therefore is an object of the present invention to provide a lever-actuated connector and a method for forming or molding a connector body, which simplify and reduce the cost of dies to be used for forming the connector, and which enable smooth insertion and fitting together of connectors.

To achieve the object described, an aspect of the present invention provides a lever-actuated connector comprising a first connector housing formed with a guide groove, a lever member engageable at an end part thereof with the first connector housing, and a second connector housing providing a pivot for the lever member to be rotated thereabout to fit the second connector housing to the first connector housing, the second connector housing being provided with a rib to be guided by the guide groove, the rib being molded with a first hole elongated in a first direction for the lever member to be slid therealong when rotated and a second hole communicating with the first hole and extending in the first direction for removal of a die element to be removed from the first hole.

Further, to achieve the object, another aspect of the present invention provides a molding method for a lever-actuated connector including a first connector housing formed with a guide groove, a lever member engageable at an end part thereof with the first connector housing, and a second connector housing providing a pivot for the lever member to be rotated thereabout to fit the second connector housing to the first connector housing, the second connector housing being provided with a rib to be guided by the guide groove, the rib being formed with a first hole elongated in a first direction for the lever member to be slid therealong when rotated, the molding method comprising molding the rib using a die element forming the first hole and a second hole connected to the first hole and extending in the first direction, and removing the die element through the second hole.

Another aspect of the present invention provides a lever-actuated connector in which a lever pivoted on a side surface of a connector body is rotated, thereby inserting and fitting the connector body into a mating connector, wherein the side surface of the connector body has at one end part thereof an upwardly and downwardly extending rib outwardly protruding therefrom, with a lever-insertion slit formed therein for an end of the lever to be swingably inserted thereinto, the lever-insertion slit being defined between mutually opposing walls, and wherein the mutually opposing walls are interconnected by an upper rib linking part and a lower rib linking part, the upper rib linking part being larger than the lower rib linking part, and a die-removal opening is formed in an upper end surface of the upper rib linking part, communicating with the lever insertion slit.

Another aspect of the present invention provides a method for forming a connector body of a lever-actuated connector in which a lever is pivoted on a side surface of the connector body, the side surface of the connector body has at one end part thereof an upwardly and downwardly extending rib outwardly protruding therefrom, with a lever-insertion slit formed therein for an end of the lever to be swingably inserted thereinto, the lever-insertion slit being defined between mutually opposing walls, and the lever is rotated to insert and fit the connector body into a mating connector, wherein the method comprises assembling upper and lower dies to be mutually aligned for an entirety of the connector body to be thereby enclosed, with a bar-shaped slit-forming die part of the upper die disposed, in a space for the lever-insertion slit to be defined therein, to extend through an upper rib linking part interconnecting the mutually opposing walls, filling a synthetic resin into a cavity defined between the dies, upwardly removing the upper die with the slit-forming die part, and downwardly removing the lower die.

BRIEF DESCRIPTIONS OF THE DRAWINGS

The above-noted and other features of the present invention will be apparent from the description of embodiments to follow, taking in combination with the accompanying drawings, in which.

DETAILED DESCRIPTION OF THE PREFERRED EMBODIMENTS

Embodiments of a lever-actuated connector and method for forming a connector body according to the present invention are described in detail below, with references being made to relevant accompanying drawings.

Figure 1:
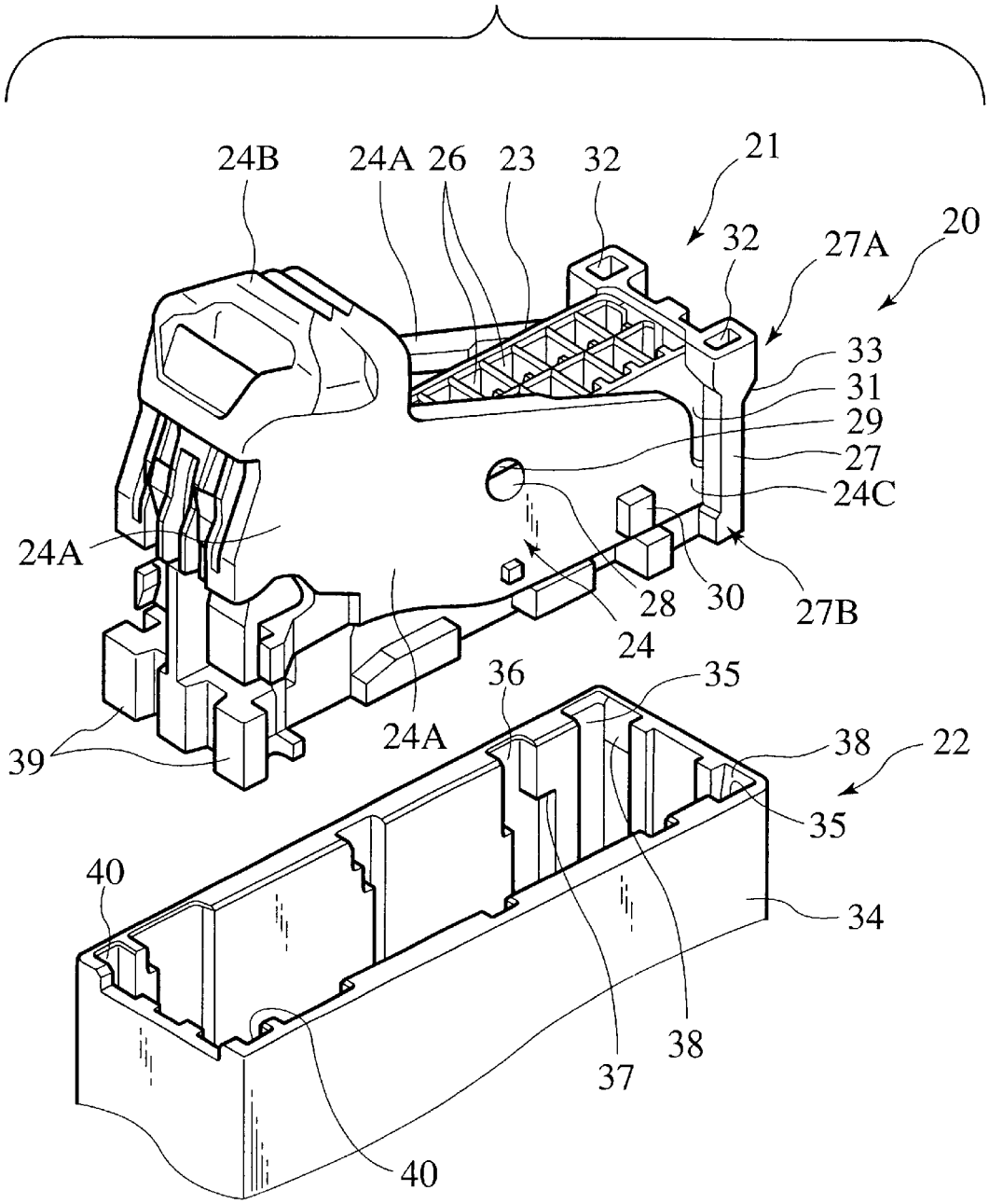
FIG. 1 is a perspective view showing an embodiment of a lever-actuated connector according to the present invention.

FIG. 1 is a perspective view of a lever-actuated connector 20 according to the present invention. As shown in this drawing, the lever-actuated connector 20 is formed by a male connector 21 and a female connector 22 provided, for example, at the top of an electrical connection housing.

The male connector 21 is formed by a connector body 23 and a lever 24 rotatably mounted to the connector body 23. The connector body 23 has a plurality of contact housing chambers 26 passing therethrough upwardly and downwardly. Inside the contact housing chambers are disposed female contact fixtures (not shown in the drawing) connected to connecting contacts of the female connector 22 (FIG. 3) inserted from the bottom. While not shown in the drawing, wires, the ends of which are connected to the female contact fixtures, lead away from the openings at the top of the contact housing chambers 26.

Lever insertion ribs 27 are provided on both side surfaces of one end of the connector body 23 so as to protrude outwardly along the direction of insertion of the connector. Bosses 28 are provided so as to protrude from both side surfaces of the connector body 23 at substantially the center parts thereof. Pivot holes 29 formed at the center of the opposing lever walls 24A of the lever 24 fit together with the bosses 28, thereby rotatably supporting the lever 24.

The lever 24 has the above-noted pair of left and right lever walls 24A, and an operating part 24B linking the lever walls 24A at the upper part of the other end thereof. At one end part of the lever walls 24A is formed an insertion protrusion 24C that is inserted into the lever insertion ribs 27 formed on the connector body 23. Between the insertion protrusions 24C and the pivot holes 29 on the outer side surfaces of the lever walls 24A are formed engaging protrusions 30 which serve as pivot points when the lever 24 is rotated.

Figure 2:
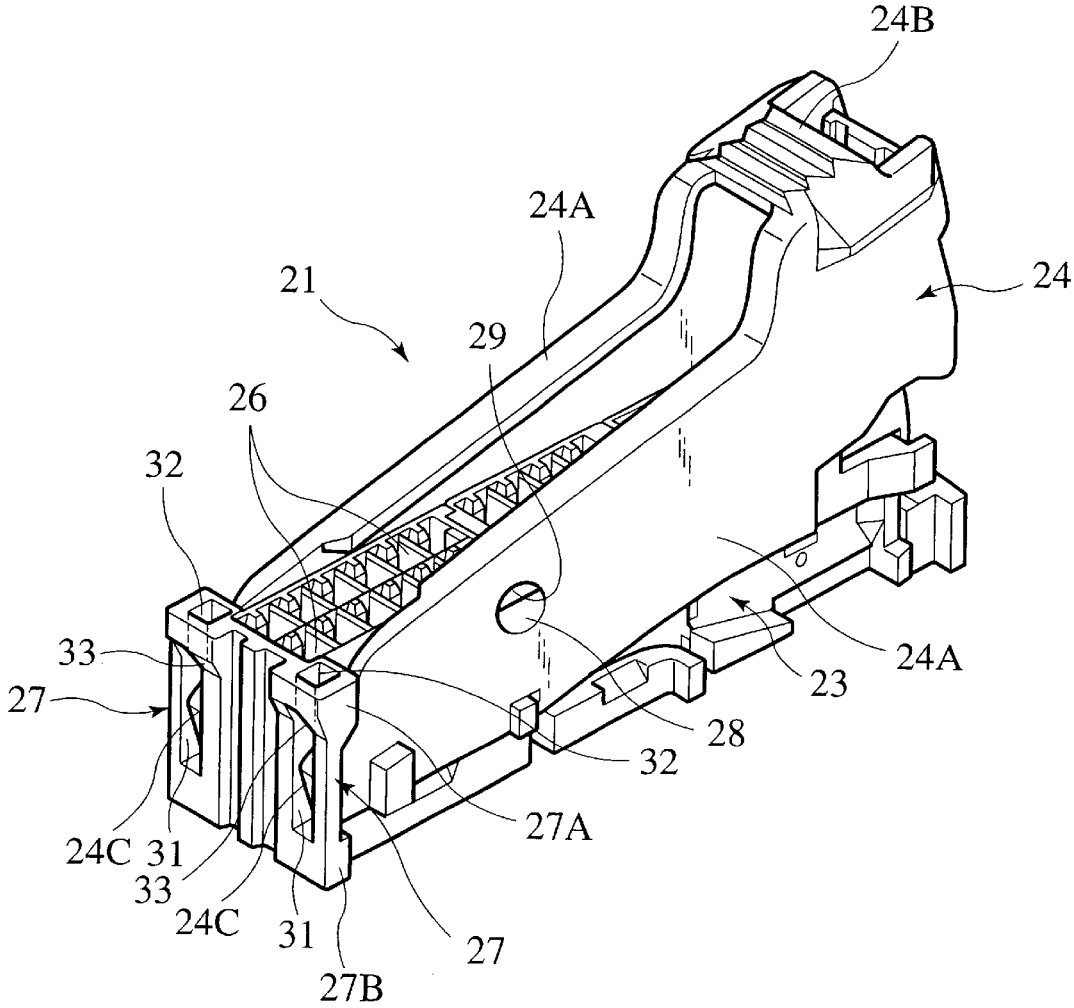
FIG. 2 is a perspective view showing a male connector in the embodiment of FIG. 1.

The configuration of the lever insertion rib 27 formed on the connector body 23 is described below, with reference to FIG. 1 and FIG. 2.

The lever insertion rib 27 has a lever insertion slit 31 in the center part in the upward/downward direction formed along the upward and downward direction (of the lever-actuated connector). An upper rib linking part 27A linking opposing walls that sandwich the lever insertion slit 31 is formed at the top part the lever insertion rib 27, and a lower rib linking part 27B linking opposing walls that sandwich the lever insertion slit 31 is formed at the bottom part of the lever insertion rib 27. The upper rib linking part 27A is formed so as to be larger than the lower rib linking part 27B. An upper through hole 32 is formed so as to pass through the lever insertion slit 31 at the top end surface of the upper rib linking part 27A. The cross-sectional shape of the upper through hole is substantially the same as the lateral cross-sectional shape of the lever insertion slit 31. As will be described below, this upper through hole 32 is an opening for the upward removal of a die when forming the lever insertion slit 31 in the process of molding the connector body 23, and is formed as a result of removing the die.

Inclined surfaces 33 are formed on side surfaces at one end of the upper rib linking parts 27A. When the connector body 23 is inserted into and fitted with the female connector 22, these inclined surfaces 33 abut a wall surface of the female connector 22, thereby functioning so as to correct tilting of the connector body 23.

The female connector 22 has a hood 34, open at the upper surface, into which the male connector 21 is inserted and fitted. On one end of the hood 34 are formed a pair of guide grooves 35, into which the lever insertion ribs 27 are inserted, extending in the upward and downward directions. These guide grooves 35 each have an inclined wall surface 38, corresponding to the inclined surfaces 33 of the upper rib linking parts 27A, at the upper part of the inner wall surface on one end thereof.

Insertion grooves 36, into which engaging protrusions 30 formed on each of the walls of the lever 24 are inserted, are formed on both side surfaces of the hood 34. Inside each insertion groove 36 is formed an engaging step 37, with which the engaging protrusion 30 engages when the lever 24 is rotated, and which serves as a pivot point for lever rotation.

Another feature of the configuration is that of guide protrusions 39 formed on the bottom part of the other end of the connector body 23, corresponding to which guide grooves 40 are formed on the inner wall at the other end of the hood 34 so as to guide the guide protrusions 39.

In a lever-actuated connector 20 configured in this manner, because the upper rib linking part 27A of the lever insertion rib 27 is formed so as to be thicker and larger than the lower rib linking part 27B thereof, it is possible to form the upper through hole 32, which has a lateral cross-section with the same shape and dimensions as the lever insertion slit 31 so that it communicates with the lever insertion slit 31.

Therefore, it is not necessary to use a sliding die to form the lever insertion slit 31, thereby enabling low-cost manufacturing of the connector body 23. By forming an inclined surface at the side surface on one end of the upper rib linking part 27A of the lever insertion rib 27, even if the connector body 23 is inserted tilted with respect to the hood 34 of the female connector 22, the abutment of this inclined surface 33 with the inclined wall surface 38 formed on the hood 34 acts to correct the attitude of the tilted connector body 23. For this reason, it is possible to prevent mutual interference between parts of the connector body 23 and the hood 34. As a result, it is possible to reduce the operating force of the lever 24, and further possible to achieve a smooth insertion and fitting together of the connector body 23 and the hood 34.

Figure 3:
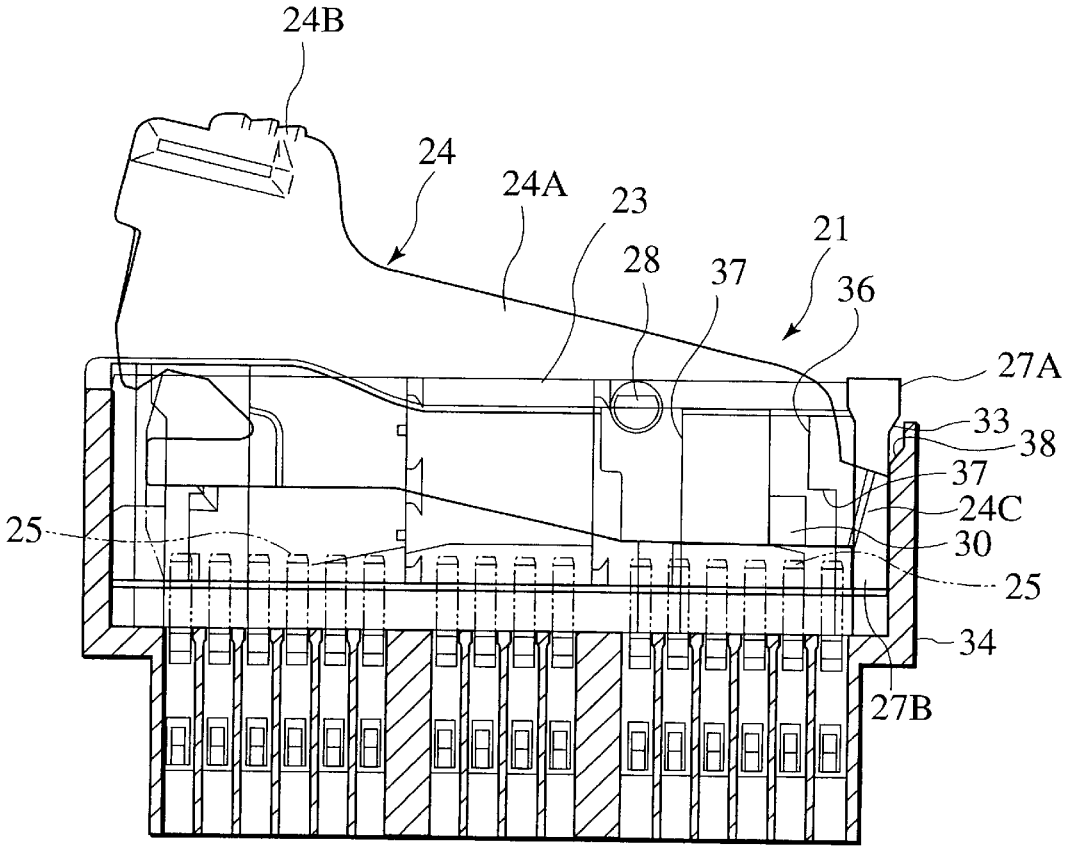
FIG. 3 is a cross-sectional view illustrating the initial insertion condition of a connector in the embodiment of FIG. 1.
Figure 4:
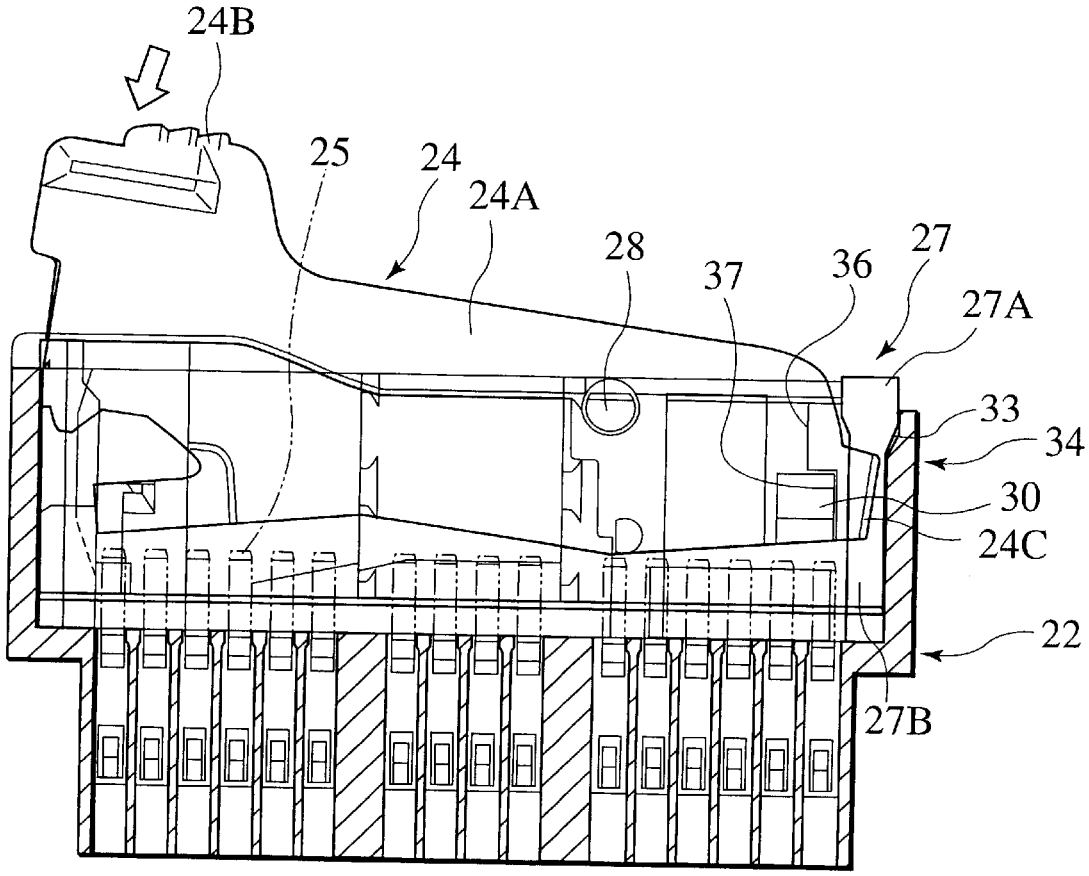
FIG. 4 is a cross-sectional view showing the intermediate insertion condition of a connector in the embodiment of FIG. 1.
Figure 5:
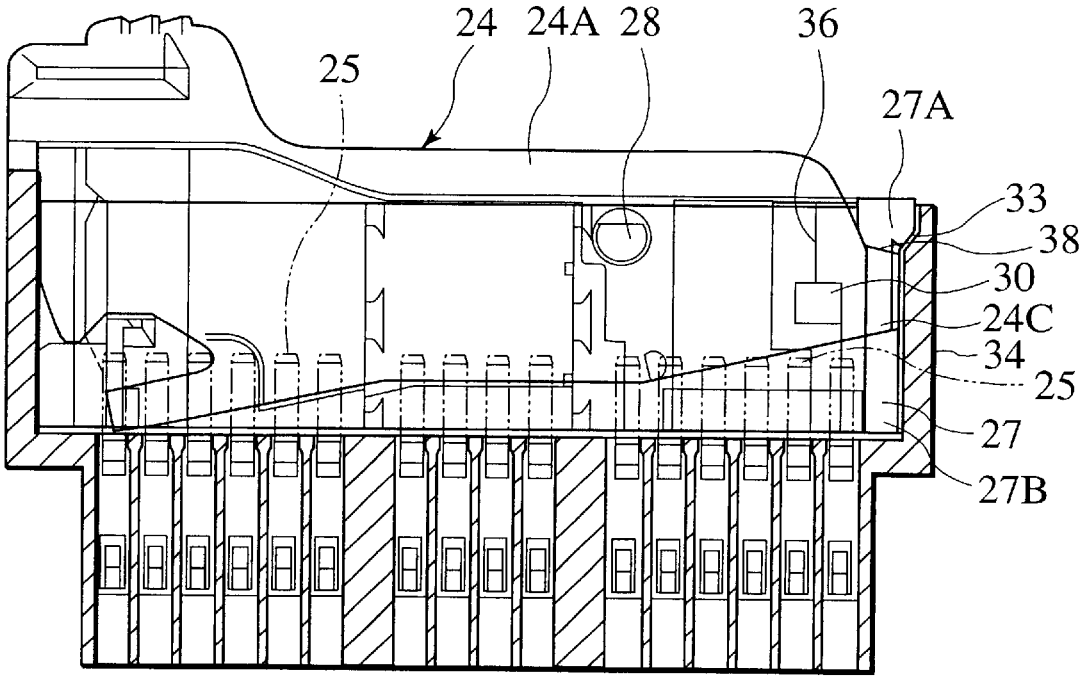
FIG. 5 is a cross-sectional view showing the final insertion condition of a connector in the embodiment of FIG. 1.

FIG. 3 to FIG. 5 are cross-sectional views showing various conditions of insertion of the male connector 21 into the hood 34 of the female connector 22. The action of insertion and fitting together is described sequentially below with reference to each of these conditions.

First, a male connector 21 and a female connector 22 in the condition shown in FIG. 1 are fitted together by inserting and fitting the connector body 23 into the hood 34 as shown in FIG. 3. When this is done, it is not necessary to operate the lever 24, it being sufficient to merely press the male connector 21 in the condition shown in FIG. 1 into the hood 34.

When the above is done, the two lower rib linking parts 27B of the lever insertion ribs 27 are inserted into the guide grooves 35 formed in the inner walls of the hood 34. Simultaneously with this, the engaging protrusions 30 are inserted into the insertion grooves 36 formed in the inner walls of the hood 34, and the guide protrusions 39 of the connector body 23 are inserted into the guide grooves 40 formed in the inner walls of the hood 34. When this occurs, the engaging protrusions 30 are positioned on the side that enables them to engage with the engaging steps 37 formed at the center part of the hood 34.

Next, as shown in FIG. 4, by operating the lever 24 so as to rotate it in the direction indicated by large arrow, so that the lever 24 rotates about the pivot holes 29 by which the bosses 28 are pivotally supported, the engaging protrusions 30 engage with the engaging steps 37 formed in the inner walls of the hood 34. When the lever 24 is further rotated, the connector body 23 is pushed into the hood 34, with the part at which the engaging protrusions 30 and the engaging steps 37 are engaged as pivot points.

If the lever 24 is rotated further, as shown in FIG. 5, the inclined surfaces 33 of the upper rib linking parts 27A of the lever insertion ribs 27 abut the inclined wall surfaces 38 on the hood 34. The action of the inclined surfaces 33 abutting the inclined wall surfaces 38 is to prevent the tilted insertion of the connector body 23.

If the connector body is inserted into the hood tilted, because there are parts of the connector body 23 and the hood 34 that mutually interfere, there is an increase in the operating force of the lever 24. With the present invention, however, by the abutment of the inclined surfaces 33 and the inclined wall surfaces 38, the proper mating attitude of the connector body 23 is maintained, thereby enabling reliable connector joining with easy lever operation.

Figure 6:
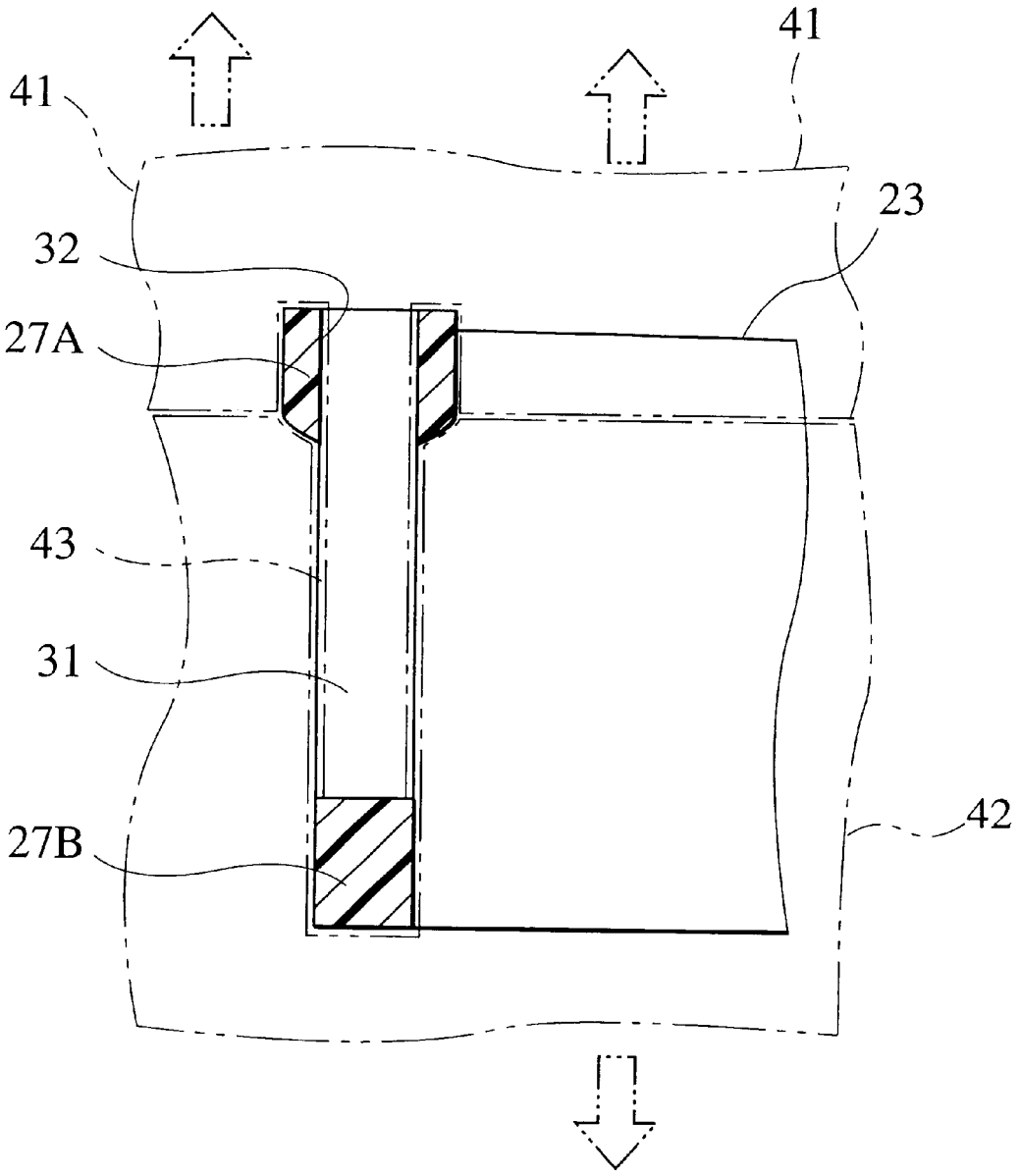
FIG. 6 is a partial cross-sectional view showing a method for forming a connector body according to an embodiment of the present invention.
Figure 7:
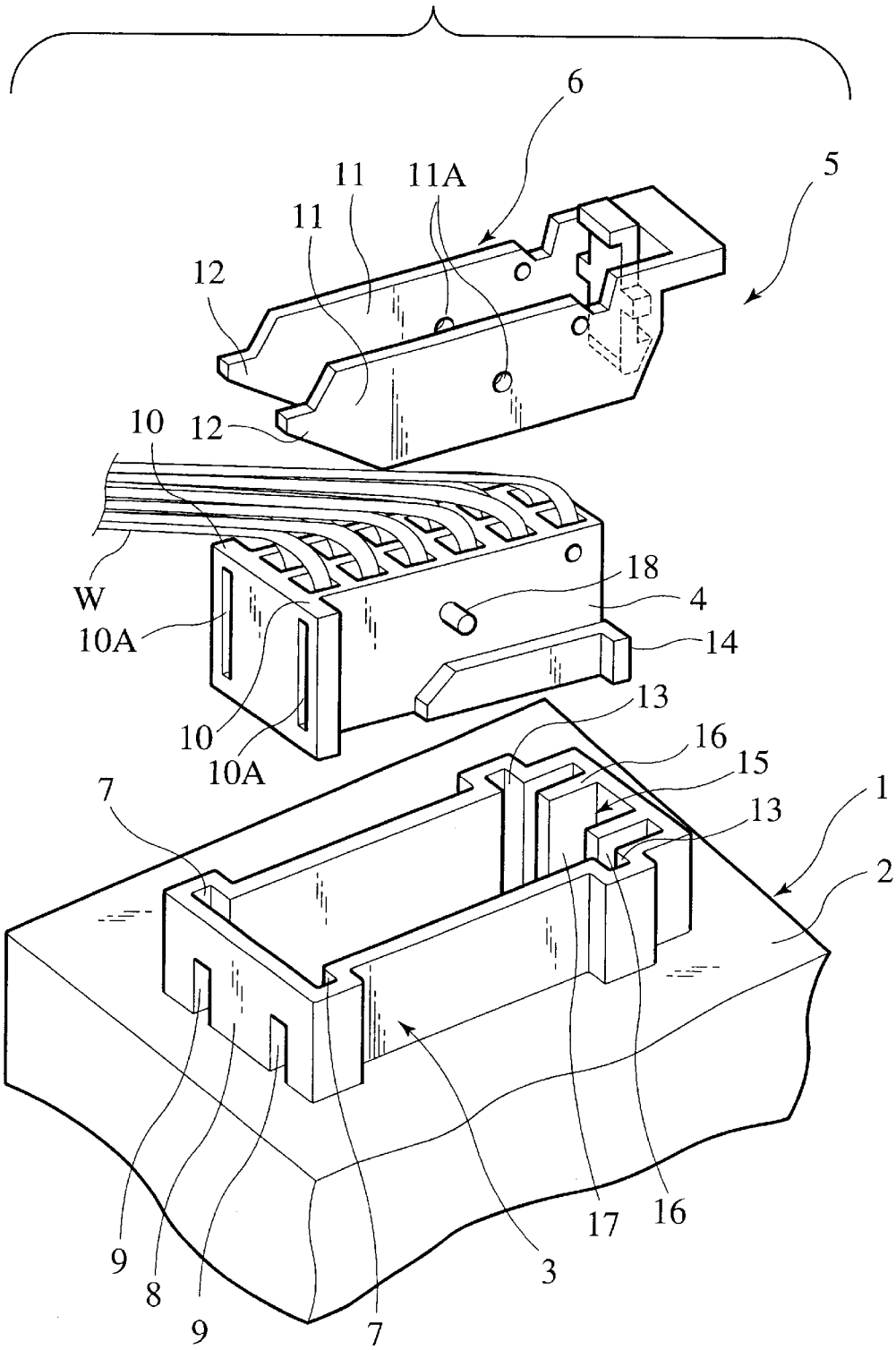
FIG.7 PRIOR ART
FIG. 7 is an exploded perspective view showing a conventional lever-actuated connector.
Figure 8:
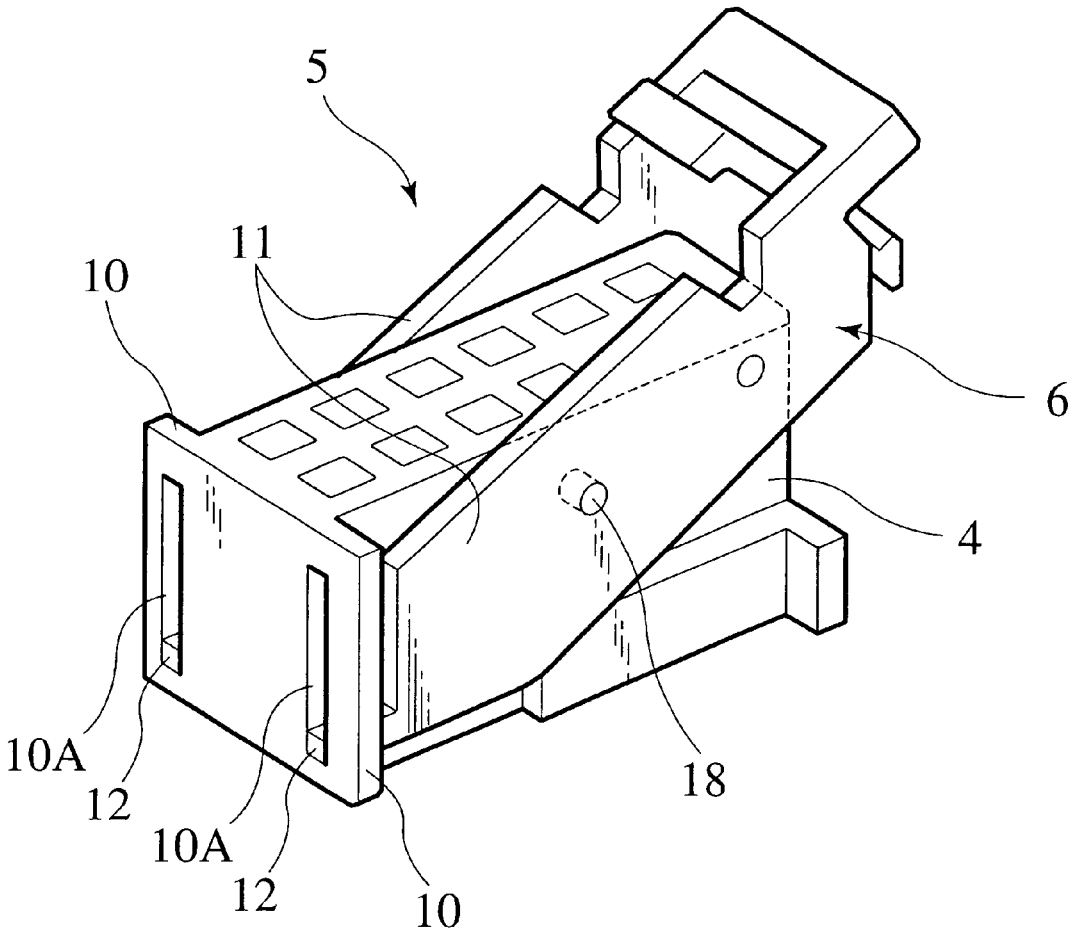
FIG.8 PRIOR ART
FIG. 8 is a perspective view of the conventional lever-actuated connector.
Figure 9:
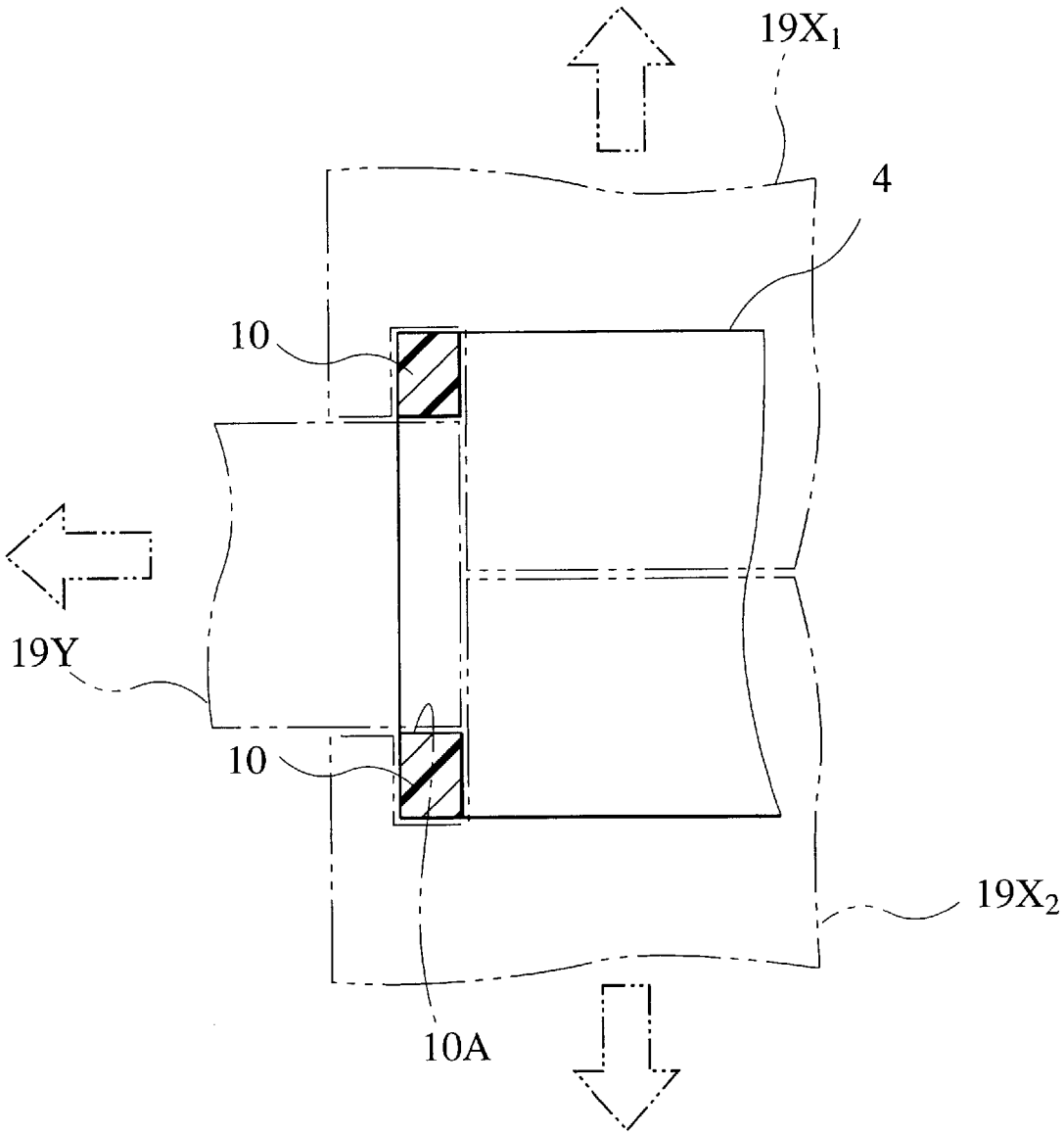
FIG.9 PRIOR ART
FIG. 9 is a partial cross-sectional view showing a method for forming a connector body of the conventional lever-actuated connector.

The method for forming the connector body 23 is described below, with reference to FIG. 6.

The connector body 23 in a lever-actuated connector 20 according to the present invention is molded from an electrically insulating synthetic resin, using a plurality of dies. As shown in FIG. 6, in this embodiment the molding of the connector body minimally uses an upper die 41 and a lower die 42. The upper die 41 has a die part 43 for forming a slit. The upper die 41 and the lower die 42 are dies for forming the overall connector body 23, and the die part 43 for forming the slit is the part that forms the lever insertion slit 27.

First, the upper die 41 and the lower die 42 are assembled together. Next, molten resin is injected into the cavity formed between the die assembled in this manner so as to fill the cavity. When this is done, the upper die 41, the lower die 42, and the slit-forming die part 43 can be removed in one and the same direction. Specifically, the upper die 41 and the slit-forming die part 43 are removed upwardly in the vertical direction and the lower die 42 can be removed downwardly in the vertical direction.

In this embodiment, as noted above, because the removal direction of each of the dies 41 and 42 and the slit-forming die part 43 is the same, it is not necessary to use a sliding die having a different removal direction, such as was used in the past, thereby simplifying the manufacturing of the die and reducing the die cost. Because the upper rib linking parts 27A of the lever insertion ribs 27 are formed so as to be thicker than the lower rib linking parts 27B, with the slit-forming die part 43 removed, it is possible to maintain the strength of the lever insertion ribs 27 that form the lever insertion slits 31. By forming inclining surfaces 33 on the upper rib linking parts 27A, and causing these to abut inclined wall surfaces formed on the hood 34, it is possible to achieve inserting and fitting of the connector 23 with the proper attitude. For this reason, lever operation is easy and smooth, and it is possible to make a reliable joint between connectors.

Although the foregoing embodiment is for the example in which the slit-forming die part 43 is formed integrally with the upper die 41, it is alternately possible to have a configuration in which the slit-forming die is inserted into the upper die 41, in which case the slit-forming die part 43 has the same removal direction as the upper die 41, so that this does not complicate the molding process.

As seen from the foregoing description, a first aspect of the embodiment provides a lever-actuated connector in which a lever pivoted on a side surface of a connector body is rotated, thereby inserting and fitting the connector body into a mating connector, wherein the side surface of the connector body has at one end part thereof an upwardly and downwardly extending rib outwardly protruding therefrom, with a lever-insertion slit formed therein for an end of the lever to be swingably inserted thereinto, the lever-insertion slit being defined between mutually opposing walls, and wherein the mutually opposing walls are interconnected by an upper rib linking part and a lower rib linking part, the upper rib linking part being larger than the lower rib linking part, and a die-removal opening is formed in an upper end surface of the upper rib linking part, communicating with the lever insertion slit.

In this aspect, because the upper rib linking part is formed larger than the lower rib linking part in the rib into which the lever end is inserted, it is easy to form a die-removal opening so as to communicate from the upper end surface of the upper rib linking part to the lever insertion slit, thereby maintaining the mechanical strength of the rib linking part. By doing this, it is possible to form the lever insertion slit by upward or downward die removal. As a result, it is possible to form the connector body by only a upward and downward die removal.

A second aspect of the embodiment is a variation on the first aspect, wherein an inclined surface is formed on a surface of the upper rib linking part opposing the mating connector, and an inclined wall surface abutting the inclined surface and correcting the fitting orientation of the connector body is formed on the mating connector.

With the second aspect, in addition to achieving the effect of the first aspect, by forming an inclined surface on the part of the upper rib linking part, which is formed so as to be larger than the lower rib linking part, opposing the mating connector so as to abut an inclined wall surface of the mating connector, if the connector body is inserted into the mating connected in a tilted attitude, the abutting of the inclined wall surface with the inclined surface acts to correct the insertion attitude of the connector body to the proper attitude. For this reason, the second aspect not only enables smooth insertion of the connector body, but also reduces the operating force of the lever.

A third aspect of the embodiment is a variation on either the first or the second aspect, wherein the connector body is formed by a pair of upper and lower dies which are removed in the upward and downward directions of the connector body, and a die part for forming a bar-shaped slit, disposed in a space between the die-removal opening and the lever insertion slit, and which is removed in the upward and downward directions.

With the third aspect, in addition to achieving the effects of the first and the second aspects, because the upper and lower dies and slit-forming die part are all removed in the upward and downward directions, it is not necessary to use a sliding die, thereby enabling a reduction in the cost of dies used to form the connector body. By using a slit-forming die part, in addition to facilitating molding, because the upper rib linking part is formed larger than the lower rib linking part, it is possible to achieve mechanical strength in the upper rib linking part.

A fourth aspect of the embodiment is a variation on any one of the first to third aspects, wherein the mating connector has a hood for housing the connector body, and wherein an engaging protrusion on the side surface of the lever engages with an engaging step formed on an inner wall of the hood, thereby serving as a pivot point when the connectors are fitted together.

With the fourth aspect, therefore, in addition to achieving the effects of the first to third aspects, by causing the engaging protrusion on the lever side to engage with the engaging step formed on the inner wall of the hood, it is possible to achieve force-multiplying leverage using the lever, thereby enabling easy insertion of the connector body into the hood and easy joining between connectors.

A fifth aspect of the embodiment provides a method for forming a connector body of a lever-actuated connector in which a lever is pivoted on a side surface of the connector body, the side surface of the connector body has at one end part thereof an upwardly and downwardly extending rib outwardly protruding therefrom, with a lever-insertion slit formed therein for an end of the lever to be swingably inserted thereinto, the lever-insertion slit being defined between mutually opposing walls, and the lever is rotated to insert and fit the connector body into a mating connector, wherein the method comprises assembling upper and lower dies to be mutually aligned for an entirety of the connector body to be thereby enclosed, with a bar-shaped slit-forming die part of the upper die disposed, in a space for the lever-insertion slit to be defined therein, to extend through an upper rib linking part interconnecting the mutually opposing walls, filling a synthetic resin into a cavity defined between the dies, upwardly removing the upper die with the slit-forming die part, and downwardly removing the lower die.

With the fifth aspect, because the upper and lower dies and the slit-forming die are all removed upwardly and downwardly, it is not necessary to have a sliding die, thereby enabling a reduction in the cost of dies for molding the connector body. Additionally, by simplifying the assembly and removal of the dies, it is possible to efficiently produce the connector body, and to reduce the production cost thereof.

The foregoing has been a description of the present invention using exemplary embodiments, and it will be readily understood that these embodiments do not restrict the present invention, which can take on other various forms within the scope of the claims and spirit thereof.

What is claimed is:

1. A lever-actuated connector comprising:

a first connector housing formed with a guide groove;

a lever member engageable at an end part thereof with the first connector housing; and a second connector housing providing a pivot for the lever member to be rotated thereabout to fit the second connector housing to the first connector housing, the second connector housing being provided with a rib to be guided by the guide groove, the rib being molded with a first hole elongated in a first direction for the lever member to be slid therealong when rotated, and a second hole communicating with the first hole and extending in the first direction for removal of a die element to be removed from the first hole.

2. A lever-actuated connector according to claim 1, wherein the rib is bulged around the second hole in a second direction crossing the first direction.

3. A lever-actuated connector in which a lever pivoted on a side surface of a connector body is rotated, thereby inserting and fitting the connector body into a mating connector, wherein the side surface of the connector body has at one end part thereof an upwardly and downwardly extending rib outwardly protruding therefrom, with a lever-insertion slit formed therein for an end of the lever to be swingably inserted thereinto, the lever-insertion slit being defined between mutually opposing walls, and wherein the mutually opposing walls are interconnected by an upper rib linking part and a lower rib linking part, the upper rib linking part being larger than the lower rib linking part, and a die-removal opening is formed in an upper end surface of the upper rib linking part, communicating with the lever insertion slit.

4. A lever-actuated connector according to claim 3, wherein an inclined surface is formed on a surface of the upper rib linking part opposing the mating connector, and an inclined wall surface abutting the inclined surface and correcting the fitting orientation of the connector body is formed on the mating connector.

5. A lever-actuated connector according to claim 3, wherein the connector body is formed by a pair of upper and lower dies which are removed in the upward and downward directions of the connector body, and a die part for forming a bar-shaped slit, disposed in a space between the die-removal opening and the lever insertion slit, and which is removed in the upward and downward directions.

6. A lever-actuated connector according to claim 3, wherein the mating connector has a hood for housing the connector body, and wherein an engaging protrusion on the side surface of the lever engages with an engaging step formed on an inner wall of the hood, thereby serving as a pivot point when the connectors are fitted together.

* * * * *